United States Patent [19]

Abe et al.

[11] 4,245,595

[45] Jan. 20, 1981

[54] INTERNAL COMBUSTION ENGINE FOR MOTOR VEHICLES

[75] Inventors: Fumiyuki Abe; Yoshimasa Hayashi, both of Yokohama; Akira Kimura, Kawasaki, all of Japan

[73] Assignee: Nissan Motor Company, Limited, Yokohama, Japan

[21] Appl. No.: 920,783

[22] Filed: Jun. 30, 1978

[30] Foreign Application Priority Data

Sep. 13, 1977 [JP] Japan ..... 52-110163
Sep. 13, 1977 [JP] Japan ..... 52-110164

[51] Int. Cl.[3] ..... F02F 7/00
[52] U.S. Cl. ..... 123/195 C; 123/198 E
[58] Field of Search ..... 123/195 R, 195 C, 195 S, 123/198 E, 52 MC

[56] References Cited

U.S. PATENT DOCUMENTS

| | | | |
|---|---|---|---|
| 3,464,398 | 9/1969 | Scheiterlein et al. | 123/195 R |
| 3,540,425 | 11/1970 | Scheiterlein et al. | 123/195 R |
| 3,942,502 | 3/1976 | Gorres et al. | 123/195 R |
| 4,059,085 | 11/1977 | Mansfield et al. | 123/195 R |

FOREIGN PATENT DOCUMENTS

| | | | |
|---|---|---|---|
| 1751124 | 10/1972 | Fed. Rep. of Germany | 123/195 R |
| 1290768 | 3/1962 | France | 123/195 R |

OTHER PUBLICATIONS

Thien et al., Motor Technische Zeitschrift, vol. 32, No. 5, May 1971, pp. 145–152.
Thien et al., Motor Technische Zeitschrift, vol. 32, No. 6, Jun. 1971, pp. 185–193.

*Primary Examiner*—Craig R. Feinberg
*Attorney, Agent, or Firm*—Schwartz, Jeffery, Schwaab, Mack, Blumenthal & Koch

[57] ABSTRACT

A low noise internal combustion engine comprises a crankshaft rotatably carried by a group of bosses attached to a lower end surface of a cylinder block. The group of bosses are bridged by a frame sections to increase rigidity of the bosses against bending stress applied thereto with respect to an axis of revolution of the crankshaft.

22 Claims, 6 Drawing Figures

INTERNAL COMBUSTION ENGINE FOR MOTOR VEHICLES

BACKGROUND OF THE INVENTION

The present invention relates to a low noise internal combustion engine for motor vehicles and particularly to a construction and arrangement so as to reduce noise resulting from the vibration of the engine main body while the engine is in operation.

Vibration of a crankshaft resulting from bending stress applied thereto with respect to an axis of revolution thereof is known to be main factor of vibration of the engine main body. Conventionally, all of such vibration of a crankshaft is transferred to and received by a cylinder block because of the construction in which a group of bosses consisting of upper boss sections and mating lower boss sections detachably mounted to the corresponding upper boss sections, respectively, to form a bearing aperture which receives the crankshaft are arranged so that the upper boss sections integrally formed with the cylinder block and arranged in a longitudinally spaced relationship along the crankshaft. With this conventional construction, even if the rigidity of the cylinder block is increased, a reduction in noise level from the engine is not as much as expected and an increase in weight of the engine is great.

SUMMARY OF THE INVENTION

An object of the invention is to reduce noise level from an engine main body.

According to the invention, there is provided an internal combustion engine having a group of bosses bridged by a frame section to increase rigidity of the group of bosses against stress along the longitudinal direction of a crankshaft. With these reinforced bosses, a considerable reduction in noise level from the engine has been accomplished.

BRIEF DESCRIPTION OF THE DRAWINGS

The invention will be further described in connection with the accompanying drawings, in which.

DESCRIPTION OF THE PREFERRED EMBODIMENTS

Figure 1:
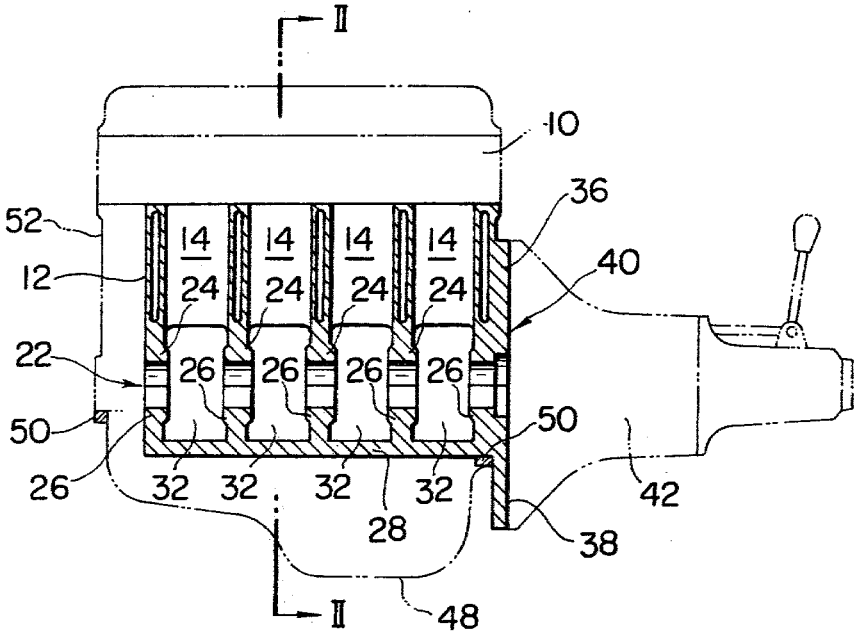
FIG. 1 is a longitudinal schematic sectional view of an engine main body in a first embodiment of an internal combustion engine according to the invention.
Figure 2:
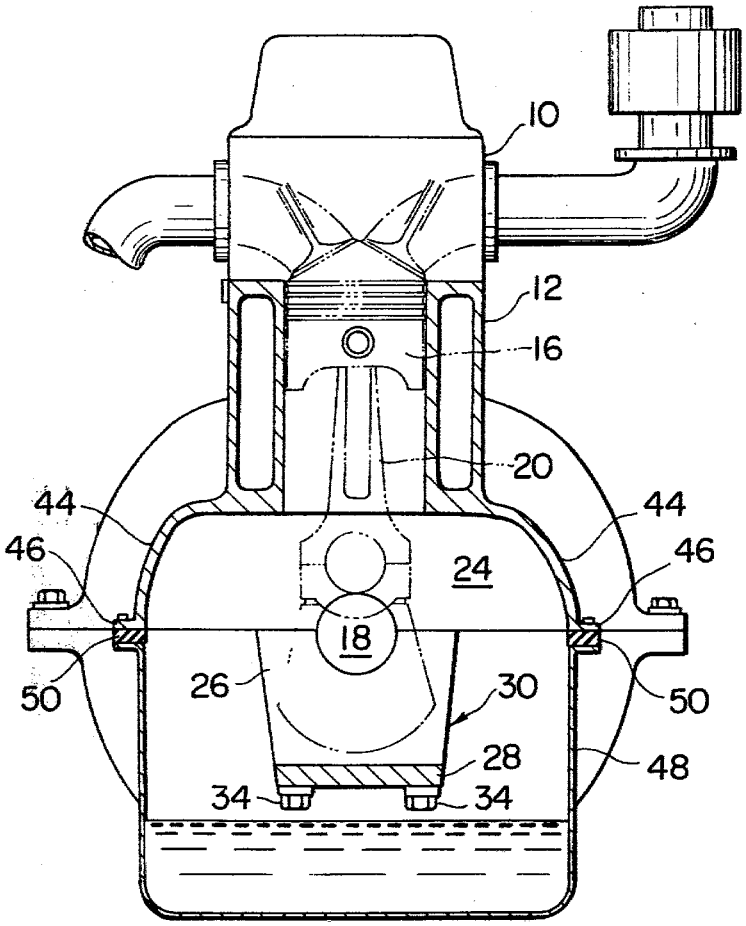
FIG. 2 is a section taken through line II—II of FIG. 1.

Referring to the accompanying drawings, FIGS. 1 and 2 show a first embodiment, while, FIGS. 3 to 6 a second embodiment.

Referring to the first embodiment shown in FIGS. 1 and 2, a group of bosses or hubs for carrying crankshaft bearings are bridged by a frame or webs to reduce vibration of the bosses upon revolution of a crankshaft, and an attachment flange for a transmission is integrally formed with a cylinder block for connection rigidity between the engine and the associated transmission.

In FIGS. 1 and 2, an internal combustion engine is schematically shown in which a cylinder head 10 is secured to an upper surface of a cylinder block 12 to close a plurality of cylinders 14, (four cylinders in this embodiment) formed in the cylinder block 12. The corresponding number of pistons, one being shown by imaginary line at 16 in FIG. 2, are reciprocably movable within the cylinders 14, respectively, and they are connected to a crankshaft 18 by the corresponding number of connecting rods 20. The crankshaft 18 is rotatably supported by crankshaft bearings (not shown) carried by a group of hubs 22.

Each of the group of hubs 22 is sectioned by a plane including the revolution axis of the crankshaft 18 into an upper hub section 24 and a lower companion hub section 26 and consists of the upper and lower sections 24 and 26. The upper hub sections 24 are integrally formed with the cylinder block 12. In this embodiment, five upper hub sections are used, two of which are arranged at forward and rearward ends of the cylinder block 12, respectively and the remaining three of which are arranged between the adjacent two cylinders, respectively.

The lower hub sections 26 are integrally formed with a frame section 28 to form a bearing frame 30. Formed in the bearing frame 30 are windows 32 to allow movement of the connecting rods 20. As shown in FIG. 2, with a plurality of bolts 34, the bearing frame 30 is securely attached to a lower surface of the cylinder block 12.

Formed integrally with the cylinder block 12 at the rear end thereof and with the bearing frame 30 at the rear end thereof are upper and lower sections 36 and 38 of an attachment flange 40 to which the associated transmission 42 is securely attached. This arrangement is responsible for an increase in connection rigidity between the engine and the transmission.

As best shown in FIG. 2, the cylinder block 12 has skirt portions 44 extending downwardly to a level adjacent the plane in which the downwardly facing faces of the upper hub sections 24 are disposed. The skirt portions 44 are formed with flanges 46 to which an oil pan 48 is attached having interposed therebetween vibration dampening members 50, such as elastomeric mumbers or rubbers.

The rigidity of the cylinder block against bending stress may be increased further if the skirt portions extend further downwardly from the above mentioned level. Denoted by the reference numeral 52 in FIG. 1 is a front cover for concealing a driving chain and its associated pulleys (not shown).

With an arrangement in which the crankshaft 18 is rotatably carried between the cylinder block 12 and the bearing frame 30 securely attached to the cylinder block 12, the rigidity of the crankshaft 18 against bending stress is considerably increased, and thus the amplitude of vibration of the engine main body upon receiving stress due to bending vibration of the crankshaft 18 is reduced to a considerably low level.

An arrangement in which the attachment flange sections 36 and 38 are integrally formed with the cylinder block 12 and bearing frame 30 will contribute to an increase in connection rigidity between the engine main body and the transmission 42. With this arrangement, rigidity of the engine main body, transmission 42 and crankshaft 18 against bending stress with respect to the revolution axis of the crankshaft 18 is increased, thus reducing unpleasant vehicle interior noise caused by vibrations in relatively low frequency range.

Furthermore the integral attachement flange sections 36 and 38 constitute thick and rigid sections through which vibrations from the engine must pass before reaching the transmission. This, in combination the flange sections and the bearing frame 30, ensures that much of the vibration which would normally be exclusively transferred to the cylinder block is directed to the relatively heavy mass defined by the transmission. Moreover, since the flange sections 36 and 38 permit a very rigid connection of the transmission to the engine per se, the engine with the bearing frame 30 and the transmission vibrate as a single unit. This unit, due to its inherently large mass, reduces the amplitude of the vibration possible for any given amount of vibration energy released from the crankshaft.

The vibration dampening members 50 will reduce transfer of high frequency vibration from the cylinder block 12 to the oil pan 48, thus suppressing the emission of such high frequency vibration from the cylinder block 12.

As compared to the conventional engine, there is an increase in weight of the engine main body due to the provision of the bearing frame 30 that has the frame section 28, and the attachment flanges to increase rigidity against bending stress, and the attachment flanges but the magnitude of the increase is not considerable because the bearing frame 30 is formed with the windows 32.

Referring now to the second embodiment shown in FIGS. 3 to 6, a cylinder block is not formed with skirt portions; a crank frame, having formed therewith a group of hubs to rotatably carry a crankshaft, is securely attached to the cylinder block the crank frame being integrally formed with an attachment flange for the associated transmission; and an oil pan extends upwardly so as to surround the outer surfaces of the cylinder block and attached to the cylinder block having interposed therebetween a plurality of vibration dampening members or rubbers.

Figure 3:
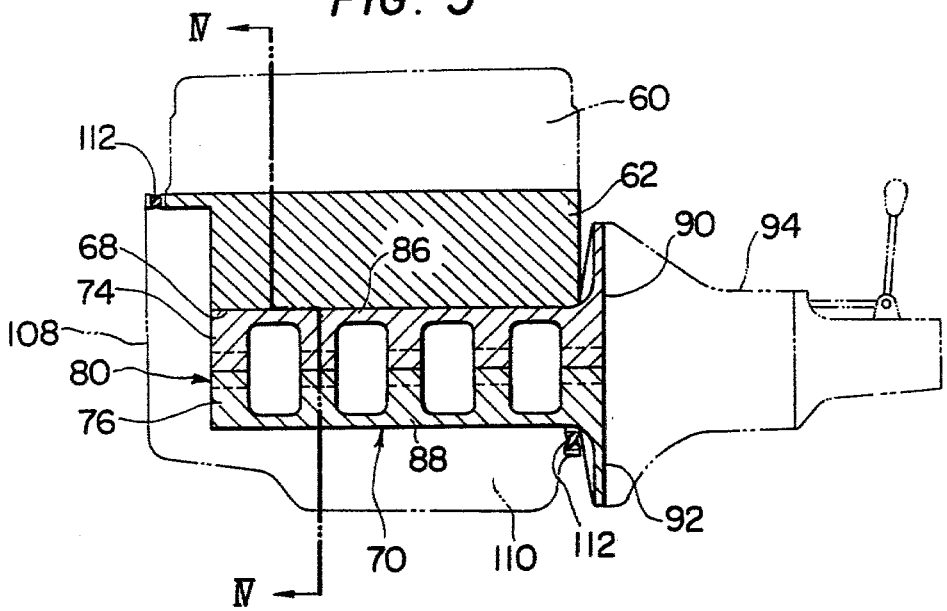
FIG. 3 is a longitudinal schematic sectional view, cut through a different section from that of FIG. 1, of an engine main body of a second embodiment of an internal combustion engine according to the invention.
Figure 4:
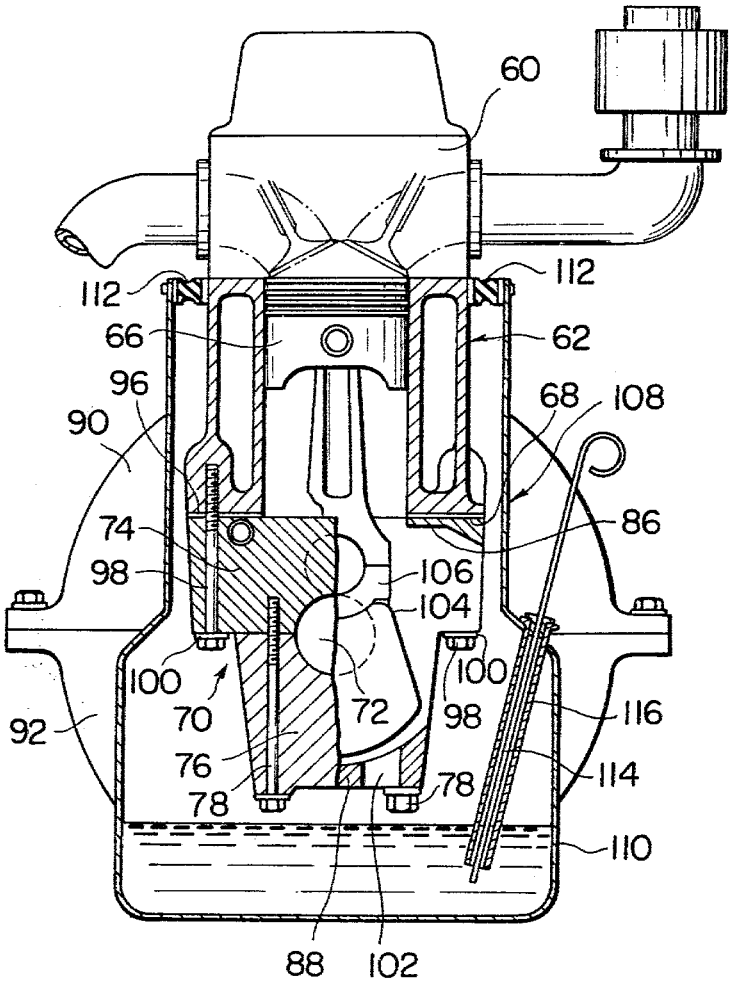
FIG. 4 is a section taken generally along line IV—IV of FIG. 3 but partly broken away.

In FIGS. 3 to 6, an internal combustion engine is schematically shown in which a cylinder head 60 is secured to an upper surface of a cylinder block 62 to close a plurality of cylinders 64 (see FIGS. 4 and 5) in which the corresponding number of pistons, one being shown at 66 in FIG. 4, are reciprocably movable, respectively. The cylinder block 62 has a lower end surface 68 in which the lower end of each piston will lie at the bottom dead center position thereof.

Attached to the lower end surface 68 is a crank frame 70 which rotatably carrys a crankshaft 72.

The crank frame 70 is sectioned by a plane including the revolution axis of the crankshaft 72 into an upper frame section 74 and a lower frame section 76. The upper and lower frame sections 74 and 76 are securely attached to each other by means of bolts 78.

Figure 5:
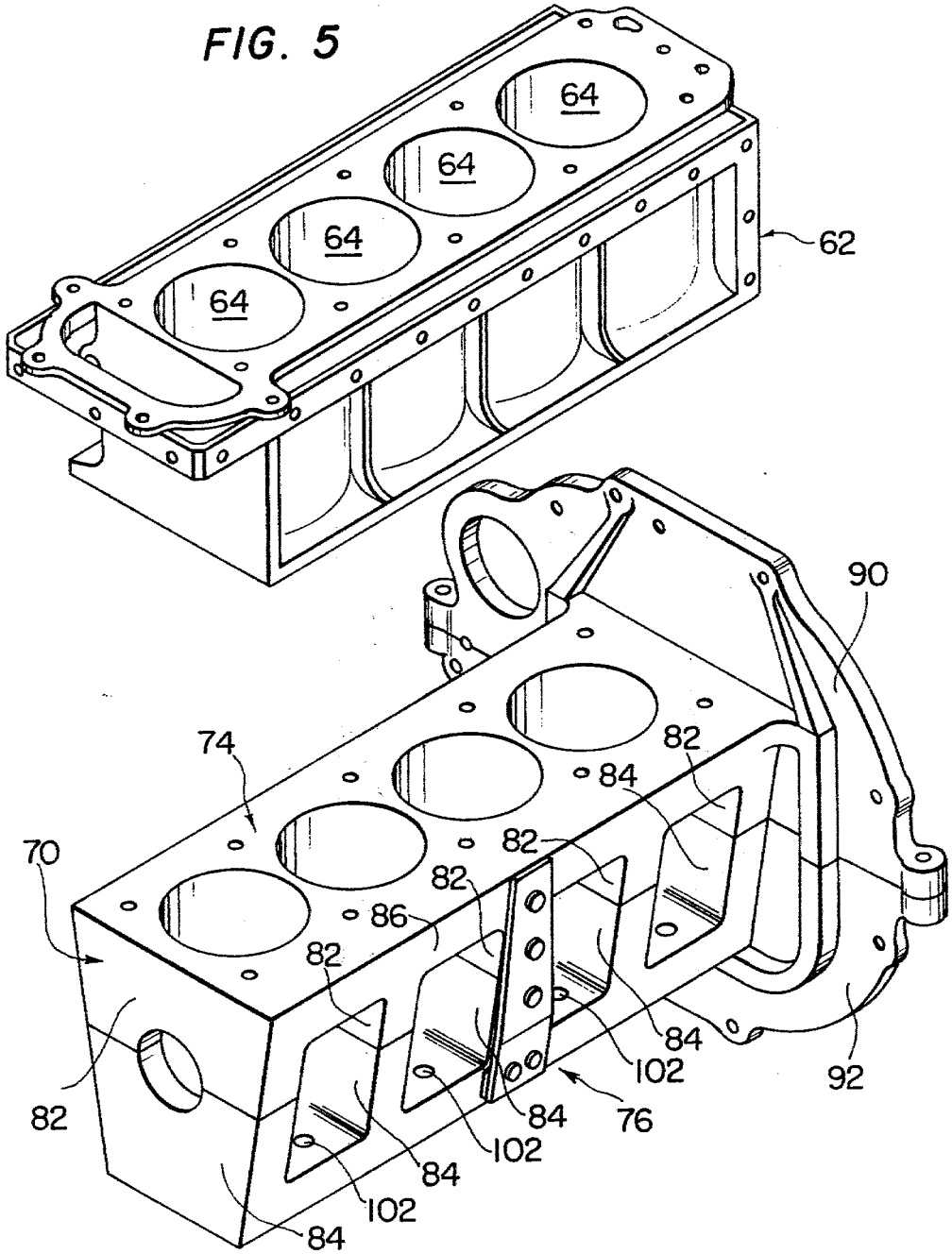
FIG. 5 is an exploded perspective view of the engine main body shown in FIG. 3.

A group of hubs 80 that carry the crankshaft 72 are sectioned by the same plane into upper hub sections 82 and lower hub sections 84. The upper hub sections 82 are arranged on an upper frame section 86 and integrally formed with the same, while, the lower hub sections 84 are arranged on a lower frame section 88 and integrally formed with the same, as best shown in FIG. 5.

Integrally formed with the upper frame section 74 at its rear end and with the lower frame section 76 at its rear end are upper and lower sections 90 and 92 of an attachment flange for the associated transmission 94 (see FIG. 1).

The upper crank frame section 74, which includes the upper hub sections 82, the upper frame section 86 and the upper attachment flange section 90, and the lower crank frame section 76, which includes the lower hub sections 84, the lower frame section 88 and the lower attachment flange section 92, are preferably formed by casting or forging so as to provide a rigid construction to the crank frame 70.

With vibration dampening means 96 interposed between the cylinder block 62 and the upper crank frame section 74, the crank frame 70 is securely attached to the cylinder block 62 by means of a plurality of bolts 98, so as to reduce the transfer of high frequency vibration occuring when the pistons 66 reciprocate in operation of the engine. Preferably, a vibration dampening washer 100 is interposed between the head of each bolts 98 and the adjacent surface of the upper crank frame section 74 for the same purpose.

Figure 6:
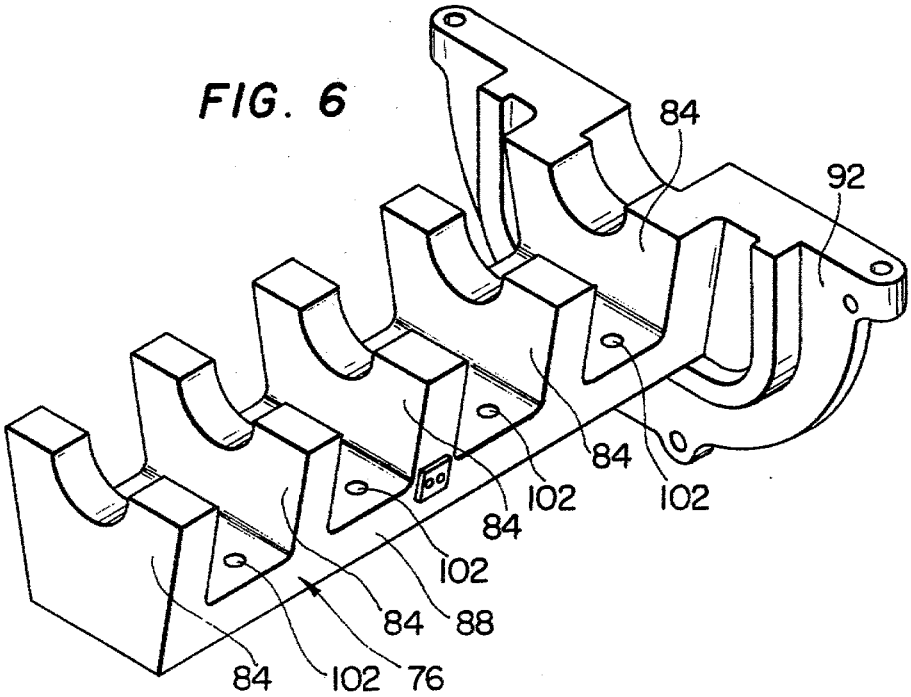
FIG. 6 is a perspective view of a lower crank frame section shown in FIG. 5.

As best shown in FIG. 6, the lower crank frame section 76 is formed with apertures for permitting a tool to extend when tightening a bolt 104 of a connecting rod 106 (see FIG. 4). The size of such apertures is determined so as not to weaken the rigidity of the crank frame 70.

An engine cover or casing 108, which serves as an oil pan 110 also, surrounds the outer surfaces of the cylinder block 62 and the crank frame 70 in a spaced relation to them and is attached thereto via a plurality of vibration dampening spacers 112, such as rubbers, as best shown in FIGS. 3 and 4. Preferably, the engine cover 108 extends upwardly and attached to the upper end surface of the engine block 62, as shown in FIG. 4. Preferably, the thickness of the engine cover 108 is the same as or greater than the conventional oil pan. If more sound proofing is required, it is preferred to make the engine cover 108 of a laminated plate having a vibration dampening layer between adjacent layers.

In FIG. 4, a oil gauge 114 extends into an oil within the oil pan 110 through a guide tube 116. Preferably, the guide tube extends into and below the normal level of the oil so that the oil level may be measured while the engine is in operation.

It will be recognized that, in the second embodiment, the skirt portion extending from a cylinder block, which would vibrate when the engine is in operation to make a noise, has been eliminated to lower the noise level from the engine.

It will also be recognized that, in the second embodiment, an engine cover which surrounds the outer surfaces of the engine in a spaced relationship thereto and attached to the engine via vibration dampening means will contribute much to a reduction in the noise level from the engine.

What is claimed is:

1. In an automotive vehicle, the combination of:

an internal combustion having a cylinder block;

a crankshaft;

a plurality of bosses each defining a bearing in which said crankshaft is journalled, said bosses each being formed in first and second halves, said first halves being integrally formed with one another and connected with said cylinder block, said second halves being integrally formed to define a bearing frame detachably connected to said cylinder block;

a first flange section formed integrally with said first halves, said first flange section extending radially with respect to said crankshaft; and a second flange section formed integrally with said second halves, said second flange section extending radially with respect to said crankshaft and mating with said first flange section and being connected thereto to define a transmission mounting site;

a separate oil pan having a portion secured to an integral member comprised of said bearing frame and said second flange section;

a vibration damping member disposed between said oil pan and said integral member to reduce transfer of vibration to said oil pan; and a speed change transmission having a case mounted to said engine through said mounting site comprised of said first and second flange sections;

the combination of said engine and said transmission being such that said cylinder block, said bearing frame and said transmission vibrate as a single unit, whereby the amplitude of the vibration thereof is reduced due to the inherent mass thereof.

2. In an internal combustion engine, a plurality of spaced first hub sections, a plurality of spaced second hub sections, each abutting one of said first hubs to define a crankshaft bearing aperture therebetween;

a first rigid member formed integrally with and interconnecting each of said first hub sections;

a second rigid member formed integrally with and interconnecting each of said second hub sections;

a first rigid substantially semi-circular flange section formed integrally with said first rigid member;

a second rigid substantially semi-circular flange section formed integrally with said second rigid member, said first and second rigid flange sections mating and being connected together to define a substantially circular mounting site for a speed change transmission, said mounting site having an area at least equal to the outer dimensions of a transmission to be mounted thereon;

a separate oil pan having a portion secured to an integral member comprised of said frame section and said second flange section; and a vibration damping member disposed between said oil pan and said integral member to reduce transfer of vibration to said oil pan.

3. An internal combustion engine as claimed in claim 2, wherein said first rigid member is formed integrally with said cylinder block.

4. In an automotive vehicle, the combination comprising:

an internal combustion engine having a cylinder block;

a crankshaft;

a plurality of bosses, each defining a bearing in which said crankshaft is journalled, said bosses each being divided into first and second boss sections, said first boss sections being connected with said cylinder block, said second boss sections being integrally formed on and interconnected in series by a frame section;

a first flange section formed integrally with said first boss sections, which first flange section extends radially with respect to said crankshaft;

a second flange section formed integrally with said second boss section and said frame section, said second flange section extending radially with respect to said crankshaft, a transmission including a housing, said first and second flange sections being detachably secured with each other to define a mounting site having a configuration substantially identical with the configuration of said transmission housing, said mounting site having an area at least equal to the area of said transmission housing, said transmission housing being secured to said mounting area so that said transmission housing is rigidly connected to said frame section and said second boss sections via said second flange section;

a separate oil pan having a portion secured to an integral member comprised of said frame section and said second flange section; and a vibration damping member disposed between said oil pan and said integral member to reduce transfer of vibration to said oil pan.

5. The combination as claimed in claim 4, wherein said internal combustion engine includes two skirt portions integrally formed with said cylinder block and depending therefrom at most as far as the level of the axis of said crankshaft, said oil pan comprises walls flangedly connected to said skirt portions, and vibration damping members interposed between said oil pan and said skirt portions, whereby transfer of fibration to said oil pan is reduced by means of said vibration damping members.

6. The combination as claimed in claim 4, wherein said cylinder block, said first boss sections and said first flange section are integrally formed.

7. The combination as claimed in claim 4, wherein said first boss sections are integrally formed on and interconnected to one another by a second frame section, said second frame section being connected to said cylinder block; and further comprising vibration damping member interposed between said second frame member and said cylinder block.

8. The combination as claimed in claim 4, wherein said oil pan surrounds said plurality of bosses and the outer surfaces of said cylinder block in a spaced relation to same, and is connected with upper portions of said cylinder block, and said engine further includes vibration damping members interposed between said oil pan and said upper portion of said cylinder block.

9. A multicylinder internal combustion engine having a crankshaft and having connected thereto a speed change transmission, said engine comprising:

a cylinder block;

a plurality of first boss sections depending from said cylinder block;

a first flange section extending radially with respect to the crankshaft and being formed integrally with said first boss sections so as to be rigidly interconnected with same;

a frame section;

a plurality of second boss sections depending from said frame section, each of said second boss sections mating with one of said first boss sections to define an aperture for rotatably supporting the crankshaft;

a second flange section extending radially with respect to the crankshaft and being formed integrally with said frame section, said first and second flange sections mating and being secured with each other to define a mounting site having a configuration substantially identical with the outer dimensions of the transmission;

a separate oil pan having a portion secured to an integral member comprised of said frame section and said second flange section; and a vibration damping member disposed between said oil pan and said integral member to reduce transfer of vibration to said oil pan.

10. An internal combustion engine as claimed in claim 9, in which said cylinder block, said plurality of first boss sections and said first flange section define a single integral body.

11. An internal combustion engine as claimed in claim 9, further comprising two skirt portions, each of which is integral with said cylinder block and extends downwardly therefrom at most as far as the level of the axis of said crankshaft, wherein said oil pan is elastically connected to said skirt portions and said second flange via the interposition of a vibration damping member.

12. An internal combustion engine as claimed in claim 9, in which said second flange section comprises an integral oil pan connection flange which extends in the axial direction of said crankshaft.

13. An internal combustion engine as claimed in claim 9, in which said first and second flange sections comprise ribs to increase the rigidity thereof.

14. An internal combustion engine as claimed in claim 9, in which said plurality of first boss sections and said first flange section are integrally interconnected by a second frame section which is fastened to said cylinder block.

15. An internal combustion engine as claimed in claim 14, wherein said oil pan encloses said crankshaft and said cylinder block and is elastically connected to upper portions of said cylinder block via the interposition of a vibration damping member.

16. A low noise internal combustion engine comprising:

a cylinder block;

a plurality of bosses, each being divided into a first section and a second companion boss section;

a crankshaft rotatably carried by and extending through said plurality of bosses;

said first boss section being integrally connected together and being connected to said cylinder block in spaced relation along an axis of revolution of crankshaft;

a frame section upon which said second boss sections are integrally formed and which bridges said second boss sections;

a first transmission attachment flange section extending radially with respect to said crankshaft and being formed integrally with said integrally connected first boss section;

a second transmission attachment flange section extending radially with respect to said crankshaft and being formed integrally with said frame section, said first and second transmission attachment flange sections being adapted to mate together and being secured together;

a separate oil pan having a portion secured to an integral member comprised of said frame section and said second flange section; and a vibration damping member disposed between said oil pan and said integral member to reduce transfer of vibration to said oil pan.

17. An engine as claimed in claim 16, in which said cylinder block is formed integrally with said first boss sections.

18. An engine as claimed in claim 17, in which said cylinder block is formed with skirt portions extending outwardly, said skirt portions being attached to said oil pan via vibration dampening members.

19. An engine as claimed in claim 18, in which said engine block is formed integrally with said first transmission attachment flange section.

20. An engine as claimed in claim 16, in which said first boss sections are integrally formed on and bridged by a second frame section which is securely attached to said cylinder block via vibration dampening members.

21. An engine as claimed in claim 20, including an engine cover surrounding the outer surfaces of said engine block, said plurality of bosses and said first and second frame sections in a spaced relation thereto and attached thereto via a plurality of vibration dampening members.

22. An engine as claimed in claim 21, in which said engine cover comprises a portion of said oil pan.

* * * * *